United States Patent [19]

Shaw

[11] 3,954,454

[45] May 4, 1976

[54] TEMPER EMBRITTLEMENT FREE LOW ALLOY STEEL

[75] Inventor: Bevil J. Shaw, Murrysville, Pa.

[73] Assignee: Westinghouse Electric Corporation, Pittsburgh, Pa.

[22] Filed: Apr. 9, 1975

[21] Appl. No.: 566,490

[52] U.S. Cl. ..... 75/123 J; 75/126 C; 75/126 D; 75/126 E; 75/126 F; 75/128 W

[51] Int. Cl.[2] ..... C22C 38/22; C22C 38/44

[58] Field of Search ..... 75/126 C, 128 W, 123 J, 75/126 D, 126 E, 126 F

[56] References Cited

UNITED STATES PATENTS

| | | | |
|---|---|---|---|
| 2,968,549 | 1/1961 | Brady et al. | 75/126 E |
| 3,092,491 | 6/1963 | Payson et al. | 75/126 C |
| 3,201,232 | 8/1965 | Thier | 75/126 C |
| 3,291,655 | 12/1966 | Gill et al. | 75/126 C |

FOREIGN PATENTS OR APPLICATIONS

| | | | |
|---|---|---|---|
| 46-32331 | 9/1971 | Japan | 75/126 C |
| 47-44853 | 11/1972 | Japan | 75/126 C |
| 282,658 | 4/1971 | U.S.S.R. | 75/126 C |
| 313,890 | 11/1971 | U.S.S.R. | 75/126 C |

*Primary Examiner*—W. Stallard
*Attorney, Agent, or Firm*—R. T. Randig

[57] ABSTRACT

A low alloy rotor steel is described which is substantially free of temper embrittlement within given constraints. In addition to describing the chemical composition there is included equations for predetermining the fracture appearance transition temperature of the unembrittled steel which equation permits the manufacturer to balance the alloying components within the ranges given in order to obtain a predetermined fracture appearance transition temperature, and by further balancing of the alloying components, the change in the fracture appearance transition temperature can be controlled to within ± 40F°. Drawings are included which graphically depict the area for control of the critical relationship between the molybdenum and the chromium.

5 Claims, 2 Drawing Figures

TEMPER EMBRITTLEMENT FREE LOW ALLOY STEEL

BACKGROUND OF THE INVENTION

1. Field of the Invention

The present invention relates to a low alloy rotor steel which is suitable for use in rotating apparatus which operates at elevated temperatures. The steel possesses substantial freedom from temper embrittlement, exhibits a good creep resistance and possesses a composition which when controlled in accordance with the equations which are set forth hereinafter, will provide a predetermined fracture appearance transition temperature and will reliably predict the change in the fracture appearance transition temperature. The ability to select the fracture appearance transition temperature and hence the freedom from temper embrittlement is highly valuable where the steel is used for example in rotating apparatus for power generation.

2. Description of the Prior Art

There are two steels in commercial use today which find a wide application in rotating apparatus. One steel contains about 3.5% nickel, about 1.5% chromium, about 0.5% molybdenum, about 0.12% vanadium and the balance essentially iron with incidental impurities. The other steel has a nominal composition of about 1.25% chromium, about 0.5% molybdenum and about 0.1% vanadium. These steels when properly heat treated will possess an ultimate strength of about 140 kpsi, an elongation of about 15% and will demonstrate adequate creep strength at elevated temperatures.

These steels, however, suffer one significant drawback and that is that upon heat treatment in order to obtain the requisite strength and ductility, these prior art steels are usually heated to a temperature in the range of from about 1100°F and up to the lower critical point of the steel. After such tempering heat treatment, the steels are air-cooled to room temperature.

Since it is impossible to quench large sections from the tempering temperature the toughness is adversely affected and this phenomena has been known in the trade as temper embrittlement. Temper embrittlement, of course, is that quality described as being a function of the change in the fracture appearance transition temperature which is readily manifested by the standard notched Charpy impact test. By heat treating samples of the composition in accordance with the manner in which the rotor steel is heat treated and by subjecting the heat treated steel samples to the Charpy impact test at various temperatures, usually within the range between about −200°F to about +200°F, it is seen that the fracture appearance transition temperature significantly increases and may rapidly approach temperatures higher than ambient temperature. At the same time the upper shelf energy may be decreased. The fracture appearance transition temperature can be readily ascertained by examining the fracture surface and visually determining where the fracture surface is characterized by about 50% brittle failure and 50% ductile failure during said Charpy impact testing. For a concise discussion of temper brittleness, see *The Making, Shaping and Treating of Steel*, ninth edition, published by United States Steel, page 1136 and *The Metals Handbook*, eighth edition, Volume II, entitled Heat Treating, Cleaning and Finishing, published by the American Society for Metals, page 56.

Heretofore, emphasis has been placed on the creep strength of the steel and it has been arbitrarily assumed that if the creep strength is high, this is the governing criteria for rotor steels. Such steels are exemplified by those set forth in U.S. Pat. No. 2,968,549 to Brady et al and U.S. Pat. No. 3,092,491 to Payson et al. While creep strength is a significant criteria for rotor steels operating at elevated temperature, nonetheless the toughness and more importantly the change in the fracture appearance transition temperature when the steels are maintained for extended periods of time at the embrittling temperature range and thereafter cooled to room temperature, is exceedingly important. This is especially so since the torsional stresses which the steel undergoes after cooling to room temperature or some lower temperature are significant when the machinery is once again placed in operation. If the toughness is low or the fracture appearance transition temperature has been changed so that the same is above room temperature, normal starting torques may be sufficient to fracture the rotor steel in attempting to start the rotating apparatus after cooling to room temperature. It is with this background in mind that the effect of the alloying element on the change in the fracture appearance transition temperature assumes critical relevance and control thereof is absolutely essential in comparison with the necessity for attaining the requiisite ultimate strength, ductility and creep strength commensurate with toughness.

SUMMARY OF THE INVENTION

The present invention is directed to a low alloy rotor steel which is characterized by being substantially free of temper embrittlement within predetermined given constraints and which has a balanced composition to provide a given fracture appearance transition temperature and is further balanced to provide for a predetermined change in the fracture appearance transition temperature, which steel will also have the requisite ultimate strength, ductility and creep strength.

The rotor steel has a composition which includes from about 0.18% to about 0.25% by weight of carbon, not in excess of about 0.030% by weight of sulfur, manganese not in excess of two times the sulfur content on an atomic basis, silicon as low as practical, phosphorus not in excess of 200 ppm, (parts per million) nickel up to about 4%, up to about 7% chromium, up to about 1.75% molybdenum, at least one of the carbide forming elements selected from the group of up to about 0.1% vanadium, up to about 0.1% tungsten, up to about 0.1% niobium, up to about 0.1% tantalum and mixtures thereof with the tramp elements tin, arsenic and antimony being maintained as low as possible, the balance of the alloy comprising iron with incidental impurities. Within the given composition range the alloying components are balanced so that the fracture appearance transition temperature for the unembrittled steel is selected in accordance with the equation set forth hereinafter and the alloying components are further balanced to provide a change in the fracture appearance transition temperature within the range between ± 40F° in accordance with another equation which is set forth hereinafter. The steel is heat treated to attain an ultimate strength of about at least 140 kpsi, an elongation of about 15% and adequate creep strength the same being attained without the necessity for quenching from the tempering temperature and without the constraint of being suitable for use in the temper embrittling range without temper embrittling occurring within the ± 40F° temperature constraint.

DESCRIPTION OF THE PREFERRED EMBODIMENT

Figure 1:
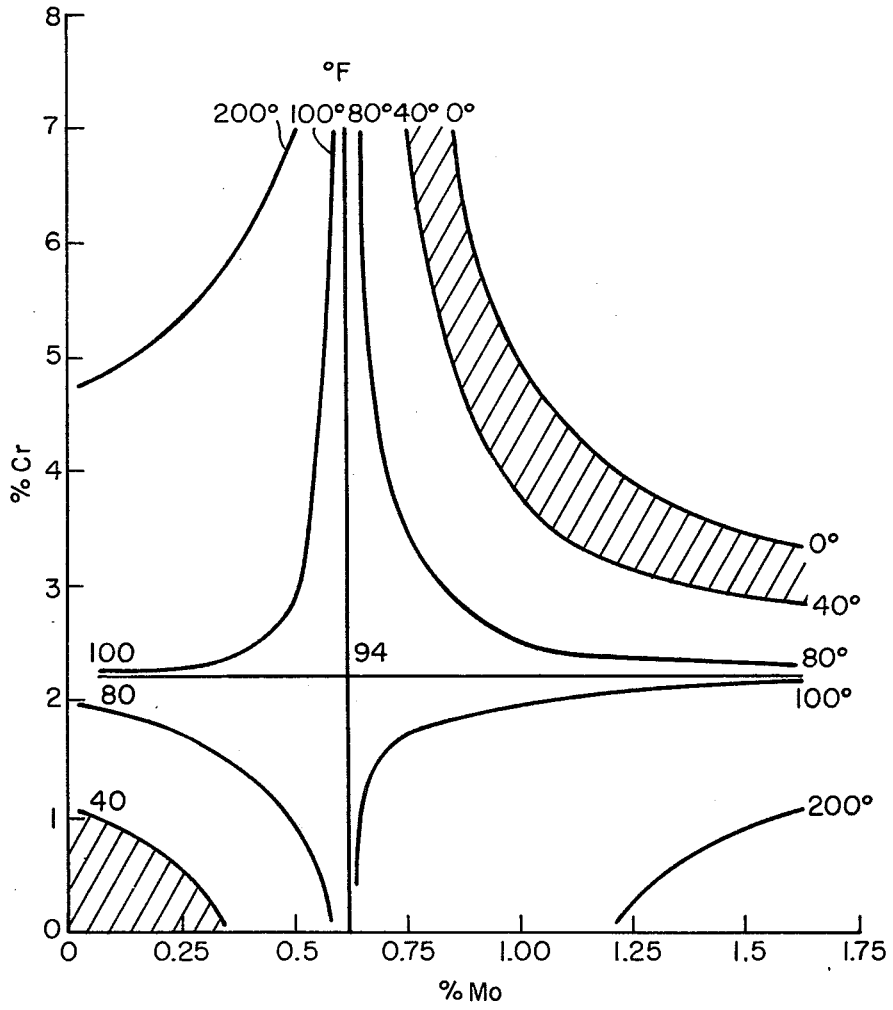
FIG. 1 illustrates the effect of chromium and molybdenum on iso-fracture appearance transition temperature based on test data; and, FIG. 2 is an iso-fracture appearance transition temperature curve illustrating the function of molybdenum and chromium based upon a statistical analysis of a least square fit to the experimental data which substantiates the concept of the present invention.

The steel of the present invention is characterized by being substantially free of the phenomenon of temper embrittlement within given constraints; the constraints may be selected as will be set forth more fully hereinafter. The steel will find particular utility when employed, for example, in rotating apparatus for power generation.

The composition of the steel includes from about 0.18% to about 0.25% by weight of carbon. Carbon is quite beneficial in contributing to both the strength and the toughness exhibited by the steel of the present invention. At least 0.18% is necessary for the steel to have sufficient strength which when heat treated and tempered will provide a strength of the order of at least about 140 kpsi. The carbon also unites with the carbide forming elements, to be discussed hereinafter, and preferentially forms a strengthening carbide which materially contributes to the overall strength and toughness of the alloy.

It is preferred, however, to maintain the carbon content not in excess of 0.25%. Within the constraints set forth hereinafter, increasing the carbon content for example from about 0.25% to about 0.30% would have the effect of increasing the unembrittled fracture appearance transition temperature. Consequently it becomes clear that increasing the carbon content above about 0.25% has the effect of embrittling the steel. When deriving the equations set forth hereinafter for determining the composition of the unembrittled fracture appearance transition temperature, it was found that the coefficient for carbon was quite high. The nickel content should also be decreased and the product of the molybdenum and chromium would of necessity be required to be increased. The carbon content of the rotor steel of the present invention is maintained within the range between about 0.18% and about 0.25% by weight of carbon.

The sulfur content of the steel of the present invention is limited to a sulphur content not in excess of about 0.030% by weight. This is a normal commercial specification for a sulfur content in this type of steel and as a result it is not necessary to make selective additions or to select the scrap component of the charge so as to obtain a significantly lower sulfur content. Commensurate with the limitation of not in excess of about 0.030% by weight of sulfur, is the fact that the manganese content which is present in the steel must be balanced with the sulfur content so that the manganese is not in excess of about two times the sulfur content when the same are compared on an atomic basis. It is imperative, however, that on an atomic basis at least sufficient manganese is present to unite with the total sulphur present to form manganese sulfide, yet the manganese content must be limited to not in excess of two times the sulfur content on an atomic basis. Thus, with whatever sulfur content is present, the manganese content is preferred to be within the range between one and two times the sulfur content on an atomic basis.

The silicon which is present within the composition of the rotor steel of this invention should be maintained as low as practical commensurate with overall economics in producing the steel. It is known that manganese and silicon pose a problem from a temper embrittlement viewpoint. It has been shown that the additions of manganese and silicon to a pure nickel-chromium-molybdenum-vanadium rotor steel enhance the embrittlement independently. This has been shown by G. C. Gould, *Temper Embrittlement in Steel* S.T.P. Vol. 407, page 59 (1968). Moreover, they also interact with phosphorus when it is present in the steel, presumably by some diffusion mechanism. While it is known that molybdenum in some fashion inhibits the effect of phosphorus, it is also known that manganese and silicon in sufficient amounts, for example about 0.3% manganese plus 0.25% silicon, are effective for overcoming this inhibiting effect of molybdenum. Consequently, it is preferred to maintain the silicon content as low as possible commensurate with the overall economics in producing the steel of the present invention.

Manganese in an amount of up to about 1.25% and silicon in an amount of up to about 0.5% have had the effect of impairing the forgeability of rotor steels in the past. Their effect on the aspect of temper embrittlement have been longly ignored. In the alloy of the present invention amounts of 1% manganese and 0.4% silicon have served to raise the change in fracture appearance transition temperature by as much as 500F°. Consequently, they must be limited in accordance with the teachings set forth hereinabove.

As adverted to hereinbefore, the phorphorus must be limited and in this respect it is contemplated that the phosphorus not exceed a value of about 200 ppm on a weight basis. Moreover, when it is considered from selecting a predetermined unembrittled fracture appearance transition temperature as well as controlling the change in the fracture appearance transition temperature in accordance with the two equations set forth hereinafter, it becomes clear that phosphorus has a very high coefficient and thus is strongly influential in its embrittling role in the steel of the present invention. The figure of 200 ppm on a weight basis is commensurate with commercial melting practice and in fact through the judicious employment of known melting techniques, the phosphorus content can be reduced significantly so that one may closely control the fracture appearance transition temperature as well as the change thereof after heating for prolonged periods of time in the embrittling temperature range.

The steel of the present invention also contemplates the presence of nickel in an amount of up to about 4% by weight. Preferably, the nickel content is maintained within this range and optimum results for toughness commensurate with its effect on temper embrittlement appear be obtained when the nickel is maintained at a value of about 1% plus or minus 0.25% by weight. The effect of nickel on the fracture appearance temperature is small although it is more significant in the overall balance of the alloying components for predicting the change in the fracture appearance transition temperature. However, when compared with the overall effect on the product of the chromium and molybdenum, the latter two alloying components are much more critical for obtaining the desired fracture appearance transition temperature. Accordingly, the nickel content is maintained within the range of up to about 4% by weight.

Unexpected results have been obtained with the judicious selection of the chromium content together with the molybdenum content. In this respect, up to about 7% by weight of chromium and up to about 1.75% by weight of molybdenum may be present within the steel of the present invention; however, when the constraints on the change in the fracture appearance transition temperature are taken into account, the chromium and the molybdenum content must be balanced within the ranges stated in accordance with the shaded portions of FIGS. 1 and 2 of the accompanying drawings.

Referring to FIG. 1, the iso-ΔFATT curves illustrate the function of molybdenum and chromium where the nickel content is maintained at about 1% and the phosphorus and tin compositions equal about 200 ppm by weight of each. These data are based upon linear interpolation and extrapolation from a statistically designed testing program, the details of which will be set forth more fully hereinafter. Thus it will be seen that where the change in the fracture appearance transition temperature is desired to be limited to about 40F°, two areas will produce such results, the first such area being where the molybdenum content ranges from about 0% to about 0.35% with the corresponding chromium content varying inversely from about 1.1% to about 0% chromium and the second such area in which the change in the fracture appearance transition temperature is limited to 40F°, the chromium may be as low as 3 and as high as about 3.75 with a corresponding molybdenum content of about 1.70%. These values decrease to about 0.95% and vary downwardly to about 0.75% for molybdenum where the corresponding chormium content is at about 7%.

Figure 2:
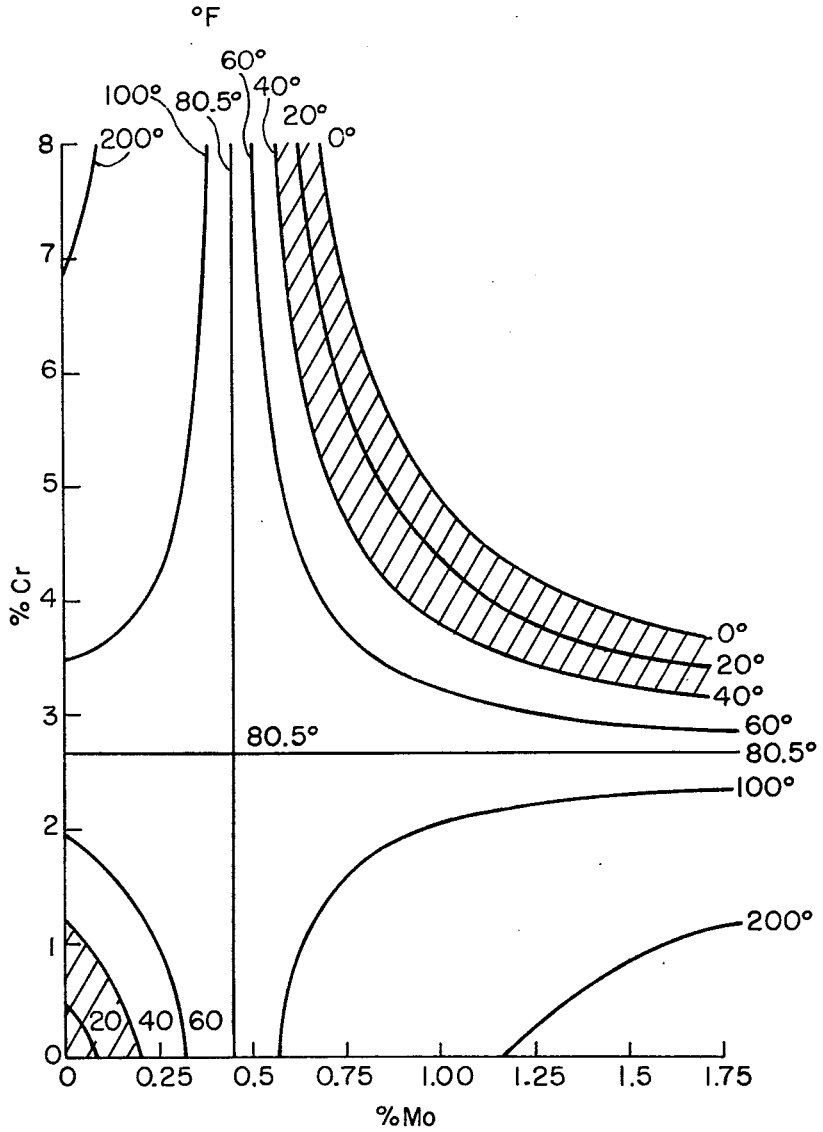

By employing a least squares fit to the experimental data, the constraints on the change in the fractural appearance transition temperature are more clearly shown by reference to FIG. 2 and the shaded areas contained therein. Thus while the chromium and molybdenum must be maintained within the stated ranges, nonetheless the same must be balanced in accordance with the shaded portions of FIGS. 1 and 2 in order to obtain the desired constraints of a change in the fracture appearance transition temperature not exceeding +40°F. Commensurate therewith, however, is the fact that the chromium and molybdenum must also be selected to have the predetermined unembrittled fracture appearance transition temperature as will be more fully set forth hereinafter with respect to the equations.

The steel of the present invention also contemplates the presence of at least one carbide forming element selected from the group of up to about 0.1% vanadium, up to about 0.1% tungsten, up to about 0.1% niobium, up to about 0.1% tantalum and mixtures thereof. The effect of the carbide forming element is to improve the strength and hardenability of the overall rotor steel. The carbide forming elements which form very fine precipitates within the microstructure provide for the main strengthening mechanism in creep since a temper embrittlement free steel would be of no benefit if it did not have adequate creep strength. By maintaining the carbide forming elements within the respectively stated ranges, no deleterious effects have been noted on the embrittling properties and where the nickel content is maintained near the lower end of the range, significant coarsening of the carbides which are formed is avoided with the result that the steel will have adequate creep resistance and yet be substantially free from temper embrittlement when the steels are used at temperatures which normally cause embrittlement in this type of composition.

In accordance with fabrication price and normal steel mill melting practices it is essential that the tramp elements tin, antimony and arsenic be maintained as low as possible. It has been shown that these elements migrate to prior austenite grain boundaries and the segregation of these elements as well as nickel, manganese and chromium at the grain boundaries have resulted in drastic increases in the fracture appearance transition temperature such that the steel was significantly embrittled when cooled to ambient temperatures after the tempering treatment. Since these tramp elements perform no beneficial functions and since they are so significantly detrimental to the embrittling characteristics of the steel, it is essential that the tramp elements tin, arsenic, phosphorus and antimony be maintained as low as possible commensurate with good fabrication, price and economic melting practice.

The balance of the chemical composition of the steel consists primarily of iron with incidental impurities, that is those impurities which are normally found in commercial steel melting operations.

In addition to the fact that the chemical composition of the steel must be maintained with the numerical limits set forth hereinbefore, it is imperative that the various alloying components be balanced to provide a predetermined fracture appearance transition temperature of unembrittled material which when expressed in °F will be in accordance with the following equation:

$$FATT_{UE}(°F) = 5.53 - 202.6(\%Mo) - 24.8(\%Cr) - 45.2(\%Ni) - 3729(\%P) - 3893\ (\%Sn) + 1645(\%CrP) + 1526\ (\%CrSn) + 1337(\%NiP) + 1123(\%NiSn) + 105.2\ (\%Mo)^2. \quad (1)$$

By inspection of the foregoing equation, (1) the fracture appearance transition temperature, in °F, can be selected for any given temperature, for example 0°F. Thus a material having a composition within the stated numerical ranges and which has the various alloying components balanced in accordance with the foregoing equation to select a fracture appearance transition temperature, the equation will, with a 95% confidence level of error of approximately ± 40F°, predict where a Charpy impact test specimen of such material will indicate a fracture surface with a 50% brittle and 50% ductile type fracture. If the selected temperature is 0°F then 95% of the compositions will exhibit an unembrittled fracture appearance transition temperature within the range between −40°F and +40°F.

Moreover, if the composition for a temper embrittlement free alloy is further balanced in accordance with the equation (2) set forth hereinafter, the change in the fracture appearance transition temperature expressed in F° will show a 95% confidence level within ± 40°F. Thus for a given composition, the change in fracture appearance transition temperature is given by the equation set forth hereinafter and 95% of the experiments will fall within 40°F of the predicted value. The equation for the change in fracture appearance transition temperature which is equal to ± 40°F is as follows:

$$\Delta FATT = -71.15 + 198.3(\%Mo) + 52.7(\%Cr) + 1.1(\%Ni) + 1610(\%P) - 5889(\%Sn) - 80.6(\%MoCr) + 1772(\%NiSn) + 182800(\%PSn). \quad (2)$$

With the foregoing constraints in mind, it is clear that numerous combinations of elements may be derived from these equations to satisfy the condition that the change in fracture appearance transition temperature is less than zero and the unembrittled fracture appearance transition temperature is less than 0°F. For example, the compositional range required for industrial levels of phosphorus and tin, for example 110 ppm on a weight basis, and with 1% nickel present, the molybdenum content can range between 1.2 and 1.5 with a corresponding chromium content between 5.0% and 4.0% by weight and these values when employing the equations as set forth hereinbefore and having the balance of the alloying components within the numerically stated ranges and balanced in accordance with the equations will illustrate in the first instance an unembrittled fracture appearance transition temperature of −59°F down to −52°F and a change in the fracture appearance transition temperature in °F varying between −148°F and −131°F.

In order to substantiate the foregoing assertions, a program was designed to study the effects of five key elements in a rotor steel, namely molybdenum, nickel, chromium, phosphorus and tin. By using a statistically designed approach, a balanced two-level fractional factorial design was employed and 16 heats with four duplicate heats consisting of high and low levels of the five elements plus carbon and iron were cast, forged and heat treated to two strength levels and embrittled to obtain the fracture appearance transition temperature data. This data was then used to established the pcincipal effects of the elements upon temper embrittlement. By making an assumption of linear interaction and effect, expressions for non-embrittled and embrittled fracture appearance transition temperatures and the change in the fracture appearance transition temperature was established. This statistical approach employed a limiting range of from 0.28% to 0.82% molybdenum, from 0.99% to 3.04% chromium, from 1.00% to 3.01% nickel, from 0.0044% to 0.0200% phosphorus, from 0.0020% to 0.0206% tin, a constant level of about 0.274% carbon and about 0.053% manganese with the balance iron was employed.

With the level of phosphorus and tin fixed at about 0.0200% by weight and with the nickel content at about 1%, then the expression for the change in fracture appearance transition temperature could be written:

$$\Delta FATT = \text{Const.} + A(Mo) + B(Cr) + C(Mo \times Cr). \quad (3)$$

In gathering up the various terms the following results were established:

| | Const. | A | B | C |
|---|---|---|---|---|
| °F | −24.6 | +192 | +54 | −87.2 |
| °C | −31.4 | +106.5 | +30 | −48.5 |

It is significant that the value for the coefficient of the molybdenum times chromium term exhibits a negative sign. This unexpectedly explains some of the anomalous effects found in the literature wherein some investigators have found that the addition of molybdenum to the steel reduces the temper embrittlement whereas others find just the opposite results, the investigators not realizing that the effect of molybdenum also depends upon the level of the chromium content. Thus the product of the molybdenum and the chromium term forms the basis for the present steel, since by raising both the molybdenum and the chromium together and reducing the nickel content, a steel can be produced with a change in the fracture appearance transition temperature which approaches zero.

A series of heats were melted and cast employing industrially high purity elements in an induction furnace and forged from a cross-section measuring 4 inches by 4 inches to a 1 inch by 1 inch cross-section. The chemical analysis of the ingots is set forth hereinafter in TABLE I.

TABLE I

| | Chemical Analyses in Wt. Percent | | | | | | | |
|---|---|---|---|---|---|---|---|---|
| Heat Designation | Mo | Cr | Ni | V | C | Mn | P | Sn |
| N1 | 0.55 | 1.95 | 0.98 | 0.006 | 0.278 | 0.05 | 0.02 | 0.0228 |
| N2 | 0.83 | 4.86 | 0.99 | 0.006 | 0.283 | 0.05 | 0.02 | 0.0223 |
| N3 | 1.25 | 2.95 | 0.99 | 0.005 | 0.273 | 0.05 | 0.02 | 0.0218 |
| N4 | 1.50 | 3.92 | 0.98 | 0.11 | 0.284 | 0.05 | 0.02 | 0.0239 |
| N5 | 0.83 | 4.88 | 0.99 | 0.12 | 0.273 | 0.05 | 0.02 | 0.0222 |
| N6 | 1.25 | 2.96 | 0.98 | 0.11 | 0.279 | 0.05 | 0.02 | 0.0239 |
| N7 | 1.48 | 3.89 | 0.99 | 0.07 | 0.267 | 0.267 | 0.02 | 0.0245 |

Each of the steels set forth in TABLE I was subjected to a common treatment of austenitizing at a temperature of 1550°F (843°C) for two hours followed by an oil quench. Thereafter, the steels were tempered for two hours and water quenched and each of the tempering temperatures was varied as will appear more fully hereinafter so that an ultimate tensile strength of approximately 155 kpsi (1070 MPa) was obtained.

It will be appreciated that by raising the tempering temperature the Ultimate Tensile Strength can be varied from high strengths at low tempering temperatures to low strengths at higher temperatures which approach the lower critical temperature. The temperature temperature selected for these experiments resulted in a strength level which would be a reverse test of the underlying theory.

Reference is directed to TABLE II which lists the tempering temperatures as well as the tensile properties of the steel both before and after being submitted to an embrittling heat treatment. The steels were quenched from the tempering temperature and thus were not embrittled in securing some of the data set forth in TABLE II.

TABLE II

| Ingot | Tempering Temp. °F | °C | Tempering Temperatures an Tensile Properties of Steels Before Embrittlement (ksi) 0.2% Yield | UTS | % Elongation | After Embrittlement (ksi) 0.2% Yield | UTS | % Elongation |
|---|---|---|---|---|---|---|---|---|
| N1 | 1075 | 579 | 131 | 153 | 18 | 132 | 151 | 17 |
| N2 | 1100 | 593 | 135 | 157 | 17.5 | 144 | 167 | 14 |
| N3 | 1100 | 593 | 135 | 163 | 18 | 147 | 172 | 15.5 |
| N4 | 1135 | 613 | 120 | 149 | 16.5 | 150 | 170 | 15 |
| N5 | 1115 | 601 | 115 | 143 | 17 | 122 | 144 | 18.5 |
| N6 | 1150 | 621 | 132 | 155 | 17 | 131 | 156 | 17 |
| N7 | 1135 | 613 | 124 | 153 | 17 | 127 | 153 | 17 |

(Note 1 ksi = 6.89 MPa)

For the express purpose of embrittling the steels, the as tempered steels were given a further step heat treatment. The stepped heat treatment consisted of heating at a temperature of 915°F (490°C) for three days or 2.6 × $10^5$ seconds followed by another heating at 860°F (460°C) for a time period of four days or 3.5 × $10^5$ seconds followed by a final heating at 750°F (399°C) for seven days or 6.0 × $10^5$ seconds. Conventional Charpy specimens were machined from embrittled steel as well as the as tempered steel. The fracture appearance transition temperature was derived from the Charpy tests and the results are set forth hereinafter in TABLE III. Twelve specimens were used to establish each curve from which the data set forth in TABLE III was derived.

TABLE III

| | FATT $FATT_{UE}$ °F | $FATT_E$ °F | ΔFATT °F | $FATT_{UE}$ °C | $FATT_E$ °C | ΔFATT °C |
|---|---|---|---|---|---|---|
| N1 | −170 | +110 | +60 | −112 | −79.5 | 32.5 |
| N2 | −45 | −25 | +20 | −42.5 | −31.5 | 11 |
| N3 | −95 | −70 | +25 | −70 | −56 | 14 |
| N4 | −25 | 0 | +25 | −31.5 | −18 | 13.5 |
| N5 | −55 | −25 | +30 | −48 | 31.5 | 16.5 |
| N6 | −140 | −60 | +80 | −95 | −51 | 44 |
| N7 | −65 | −40 | +25 | −54 | −40 | 14 |

UE = unembrittled
E = embrittled

From the foregoing data it can be seen that assuming the alloying element levels are constant except for the molybdenum and chromium, the effects of these two variables on the change in fracture appearance transition temperature may be displayed by means of FIG. 1 which shows a theoretical iso—ΔFATT as a function of molybdenum and chromium. Since these data assume the linearity of the effect of molybdenum and chromium field in equation (3) of the form set forth hereinbefore, by fitting the data by a method of least squares to the experimental data, the results can be displayed as shown in FIG. 2. Thus as the ΔFATT approaches zero and the chromium and molybdenum approach values beyond these ranges, theoretically the equation (3) would yield a negative ΔFATT which may be interpreted as showing no embrittlement after the given temper embrittlement treatment.

In the data set forth hereinbefore, the composition of about 1.5 molybdenum and about 4% chromium, which is well in the theoretically embrittlement free zone, did show some 25°F of embrittlement whereas a 0.8% molybdenum with about 5% chromium as well as another composition of about 1.25% molybdenum and 3% chromium actually demonstrated less embrittlement than would be expected. These results, however, must be quantified in the terms that the theoretical curves as set forth for the data in FIGS. 1 and 2 are for steels having an ultimate tensile strength of about 144 kpsi which is about 992 MPa, whereas the ultimate strength of the three alloys was made higher as is set forth in TABLE II.

The effect of raising the ultimate tensile strength usually results in an increase in the ΔFATT. Consequently, for accurate comparison, the experimental ΔFATT should be lower than that recorded in FIG. 1. It may thus be concluded that the effect of lowering the phosphorus and tin from the 200 ppm to normal levels found in industrial steels of the order of 100 ppm, the steel would be embrittlement free.

The fracture appearance transition temperature for the unembrittled steel for three alloys having vanadium was determined to be well below 0°F. Consequently the trend of lowering the values of phosphorus and tin from the 200 ppm level to the 100 ppm level should significantly improve the unembrittled fracture appearance transition temperature as well as the change in the fracture appearance transition temperature.

The elimination of temper embrittlement per se is of little consequence in an alloy unless several other criteria are met, namely the cost, forgeability, hardenability, and creep resistance. These characteristics must be taken into account if the steel is to have practical utility as a rotor steel. Thus lowering the level of nickel while raising the levels of molybdenum and chromium within the limits stated hereinbefore will have little change in the cost of the alloy from the prior art steels alluded to previously. By raising the level of molybdenum and chromium from the levels heretofore used in prior art steels and reducing the level of nickel normally found in the standard grades of nickel-chromium-molybdenum-vanadium steels serves to increase the hardenability of the steel.

The upper shelf levels insofar as the toughness is concerned for the high molybdenum plus chromium content varied between about 110 and about 150 foot pounds. Since the phosphorus and tin have the effect of lowering the upper shelf level, the reduction of the phosphorus and tin to industrially suitable levels provides for an improvement in the upper shelf level of about 40 foot pounds. Thus, raising the molybdenum and chromium while it lowers the toughness of the material, it does not do so to a level that may be regarded as deleterious. At the same time, the toughness of the steel will be improved with the lowered levels of phosphorus and tin.

while it may appear that chromium additions above about 1–2% appear to be detrimental to the creep properties molybdenum additions of about 1–1.2% appear to improve the creep properties. Precipitation of $M_2C$ which grow rapidly may denude the steel of the beneficial effects of fine vanadium carbide precipitates which together in common with niobium carbide and tantalum carbide provide the main strengthening in creep. Thus the alloy combination for temper embrittlement free steel has reasonable creep properties and the further alloying additions of up to 0.1% niobium, up to 0.1% tantalum and up to 0.1% tungsten either individually or in some combination do not significantly affect the embrittlement properties and serve to improve the creep properties.

Reference is directed to TABLE IV which includes the results of creep tests.

TABLE IV

| Specimen | Temp. °F | Creep Tests Stress ksi | Time to failure hours |
|---|---|---|---|
| N4 | 850 | 80 | 186 |
| | 850 | 85 | 79 |
| | 850 | 70 | → |
| N6 | 850 | 70 | → |
| | 850 | 85 | 405 |
| N7 | 850 | 85 | 592 |
| | 850 | 70 | → |
| | 850 | 90 | 143 |

→ Tests still running

From the data set forth in TABLE IV it is clear that the steel of the present invention will possess a 100 hour creep strength in excess of 80 kpsi at 850°F. If the rotor steel of the present invention is operated in the embrittling temperature range for prolonged periods of time the steel will have excellent creep strength and yet remain embrittlement free.

In order to more fully evaluate the concept of the present invention, a composition of matter which has been identified as P6 has been made and tested with the results to be set forth hereinafter. This P6 composition contained 1.18% molybdenum, 4.14% chromium, 0.99% nickel, 0.18% manganese, 0.08% silicon, 0.10% vanadium, 0.005% phosphorus and 0.23% carbon with the balance essentially iron and incidental impurities. The aim composition for tin was 0.01% and the aim composition for sulfur 0.0075%, the latter two elements not having been analyzed. This material was made and cast into ingots in the same manner as the composition set forth hereinbefore in TABLE I and the steel was subjected to hot working, cold working plus a heat treatment.

The heat treatment consisted of austenitizing the specimens at 2100°F for a period of two hours followed by oil quenching. Thereafter the specimens were tempered at a temperature of 1175°F and water quenched from the tempering temperature to provide hardness of 31 C. This corresponds to an ultimate tensile strength of about 144 kpsi. The specimens in the unembrittled condition were thereafter fabricated into standard Charpy impact specimens and 12 specimens were used to determine the fracture appearance transition temperature in the unembrittled condition which proved to be −125°F.

After subjecting the steels to the same embrittling heat treatment as was detailed hereinbefore which thermal history in accordance with the prior art would have involved an embrittled condition, the fracture appearance transition temperature of the materials as-embrittled was thereafter measured and found to be −85°F, thereby confirming a ΔFATT of about +40°F. Significantly, the upper shelf energy of these specimens in both the unembrittled as well as the embrittled condition prove to be 122 ft.-lbs. which indicates a phenomenal degree of toughness.

Other samples in the same P series of heats were melted which contained up to 1% manganese and about 0.4% silicon. After treating the samples for producing an embrittled condition and measuring the fracture appearance transition temperature the extreme embrittlement of the steels proved to be a ΔFATT of +575°F, thereby demonstrating beyond cavil the necessity for maintaining the low manganese and silicon contents as set forth hereinbefore.

From the foregoing it will become clear that the rotor steel of the present invention possesses a composition which can be controlled to provide a temper embrittlement free low alloy steel. This steel is possessed of excellent toughness, hardenability and low cost and as such can find particular use when employed in the field of power generation which will require extended operation at an elevated temperature range which normally would impair the toughness and embrittle such a steel when the composition is not controlled in accordance with the teachings hereof.

I claim:

1. A rotor steel which is substantially free of temper embrittlement within given constraints consisting essentially of from about 0.18% to about 0.25% by weight of carbon, not in excess of about 0.030% by weight of sulfur, manganese not in excess of 2 times the sulfur content on an atomic basis, silicon as low as practical commensurate with the overall economics in producing the steel, phosphorus not in excess of 200 ppm on a weight basis, nickel up to about 4% by weight, up to about 7% chromium, up to about 1.75% molybdenum, the chromium and molybdenum being balanced in accordance with the shaded portion of FIGS. 1 and 2 of the accompanying diagram, at least one carbide forming element selected from the group of up to about 0.1% vanadium, up to about 0.1% tungsten, up to about 0.1% niobium, up to about 0.1% tantalum and mixtures thereof, as low as possible amounts of tramp elements tin, arsenic and antimony and the balance essentially iron with incidental impurities, the alloying elements being balanced to provide a predetermined $FATT_{UE}$ in °F in accordance with the equation:

$$FATT_{UE}(°F) = 5.53 - 202.6(\%Mo) - 24.8(\%Cr) - 45.2(\%Ni) - 3729(\%P) - 3893(\%Sn) + 1645(\%CrP) + 1526(\%CrSn) + 1337(\%NiP) + 1123(\%NiSn) + 105.2(\%Mo)^2$$

and the elements are further balanced to provide a ΔFATT = ± 40°F in accordance with the equation:

$$\Delta FATT = -71.15 + 198.3(\%Mo) + 52.7(\%Cr) + 1.1(\%Ni) + 1610(\%P) - 5889(\%Sn) - 80.6(\%MoCr) + 1772(\%NiSn) + 182800(\%PSn).$$

2. The alloy of claim 1 in which the nickel is present within the range between 1% ± 0.25%.

3. The alloy of claim 1 in which the molybdenum content is within the range between about 1% and about 1.5% and the chromium is present within the range between about 3% and about 5%.

4. The alloy of claim 1 in which the carbide former is vanadium which is present in an amount of 0.1% ± 0.05%.

5. A rotor steel which is substantially free of temper embrittlement within given constraints consisting essentially of from about 0.18% to about 0.25% by weight of carbon, not in excess of 0.030% by weight of sulfur, manganese in an amount sufficient to react with the sulfur present within the steel but not in excess of 2 times the sulfur on an atomic basis, silicon as low as practical commensurate with the overall economics in producing the steel, phosphorus not in excess of 200 ppm on a weight basis, nickel in an amount of 1% ± 0.25%, from about 3% to about 5% chromium, from about 1% to about 1.5% molybdenum, at least one carbide forming element selected from the group of up to about 0.1% vanadium, up to about 0.1% tungsten, up to about 0.1% niobium, up to about 0.1% tantalum, and mixtures thereof, as low as possible amounts of tramp elements tin, arsenic and antimony commensurate with overall economics and the balance ran with incidental impurities, the alloying elements being balanced to provide a predetermined $FATT_{UE}$ in °F in accordance with the equation:

$$FATT_{UE}(°F) = 5.53 - 202.6(\%Mo) - 24.8(\%Cr) - 45.2(\%Ni) - 3729(\%P) - 3893(\%Sn) + 1645(\%CrP) + 1526(\%CrSn) + 1337(\%NiP) + 1123(\%NiSn) + 105.2(\%Mo)^2$$

and the alloying elements are further balanced to provide a $\Delta FATT = \pm 40°F$ in accordance with the equation:

$$FATT = -71.15 + 198.3(\%Mo) + 52.7(\%Cr) + 1.1(\%Ni) + 1610(\%P) - 5889(\%Sn) - 80.6(\%MoCr) + 1772(\%NiSn) + 182800(\%PSn).$$

* * * * *